United States Patent [19]

Kristel

[11] Patent Number: 4,595,138

[45] Date of Patent: Jun. 17, 1986

[54] TWO-WAY ENVELOPE

[75] Inventor: Ira B. Kristel, Hewlett Harbor, N.Y.

[73] Assignee: 21st Century Envelope Co., Inc., Deer Park, N.Y.

[21] Appl. No.: 695,736

[22] Filed: Jan. 28, 1985

Related U.S. Application Data

[63] Continuation of Ser. No. 496,462, May 20, 1983, abandoned, which is a continuation-in-part of Ser. No. 286,281, Jul. 23, 1981, abandoned.

[51] Int. Cl.[4] ..... B65D 27/06

[52] U.S. Cl. ..... 229/73; 383/35

[58] Field of Search ..... 229/73; 206/804; 383/35

[56] References Cited

U.S. PATENT DOCUMENTS

| | | | |
|---|---|---|---|
| 1,064,302 | 6/1913 | Donohue . | |
| 1,145,935 | 7/1915 | Steinke . | |
| 1,373,512 | 4/1921 | Kuhhorn . | |
| 1,953,192 | 9/1932 | Rossiter . | |
| 2,317,335 | 8/1939 | Whitman . | |
| 3,224,574 | 12/1965 | McConnell et al. | 383/35 |
| 3,270,948 | 9/1966 | Donovan . | |
| 3,411,698 | 11/1968 | Reynolds | 383/35 |
| 3,558,040 | 5/1969 | Krueger . | |
| 4,081,127 | 3/1978 | Steidinger . | |
| 4,308,987 | 1/1982 | Solomon | 229/73 |
| 4,332,346 | 6/1982 | Kronman | 229/73 |
| 4,382,539 | 5/1983 | Kronman | 229/73 |

FOREIGN PATENT DOCUMENTS 640797 7/1950 United Kingdom .

*Primary Examiner*—Stephen P. Garbe

*Attorney, Agent, or Firm*—Lerner, David, Littenberg, Krumholz & Mentlik

[57] ABSTRACT

A two-way envelope made up from a one piece blank comprising front and back panels joined along three sides thereof to form a container. A first sealing flap is joined along a perforated line to the free side of the front panel and a return sealing flap is joined along a first fold line to the free side of the back panel. The front panel is preferably larger than the back panel, and the front panel is formed with a fold line space a predetermined distance from the perforated line so that the distance from the outer fold line to the bottom of the front panel is greater than the distance from the bottom to the top of the back panel.

The return sealing flap is inwardly folded upon itself to permit a larger return flap to be carried within the envelope during the first mailing. At least one crimped portion is provided in the return sealing flap to facilitate the handling of the flap by the first addressee.

33 Claims, 10 Drawing Figures

TWO-WAY ENVELOPE

This is a continuation of application Ser. No. 496,462 filed May 20, 1983, now abandoned, which is a continuation-in-part of prior application Ser. No. 286,281, filed July 23, 1981, now abandoned.

BACKGROUND OF THE INVENTION

Two-way envelopes in which the same envelope can be used on the initial trip from the sender to the addressee and reused on a return trip from the original addressee back to the sender are well-known in the envelope art. The advent of computerized and automated postal system handling and routing of mail, however, have made prior art two-way envelopes unsuitable in certain respects.

Computerized and automated routing of mail requires that certain information be placed upon the front face of the envelope in a position where it can be "read" or sensed as the envelopes pass through sorting and transporting devices so that they may be directed to their proper destinations. The most convenient location for such information is just above the bottom edge of the front of the envelope. Since most two-way envelopes employ a first sealing flap for the initial mailing and a second sealing flap for the return trip, the second sealing flap must now be of a length sufficient to cover the entire front face of the envelope on the return trip.

Where the second sealing flap is carried within the pocket of the envelope during the initial mailing and must be slipped out of the said pocket for sealing the envelope for the second mailing, the increased length required to cover the front face of the envelope, including the area near the bottom occupied by the postal routing information, presents problems which could interfere with the successful use of the envelope and even cause it to become destroyed.

The further the second sealing flap extends into the pocket of the envelope, the more difficult it becomes for the recipient to distinguish it from the back panel of the envelope, and therefore, recognize the envelope as a two-way envelope. In addition, the free edge of the second sealing, which must be captured in order to pull the said flap out of the pocket, is difficult to find as the second sealing flap is made longer. Often an unskillful person, in trying to capture the free end of the flap, will tear the envelope at its side seams, thereby destroying the usefulness of the envelope.

While it is possible to fold the second sealing flap upon itself before placing it within the envelope pocket as the envelope is assembled, since the second sealing flap must now not only be long enough to cover the entire front face of the envelope and also extend over the top of the envelope and its contents on the return trip, the same problems arise.

Accordingly, it is an object of the present invention to provide a two-way envelope capable of use where the entire front face of the envelope must be covered on the return trip.

Another object of the present invention is to provide a two-way envelope having a second sealing flap which is easy to locate and grasp within the envelope pocket.

A further object of the present invention is to provide a two-way envelope second sealing flap which is long enough to cover the entire front face of the envelope and which may be withdrawn From the envelope pocket without danger of tearing the envelope side seams.

BRIEF DESCRIPTIONS OF THE DRAWINGS

In the accompanying drawings which are made part hereof, similar elements have been given the same reference numerals, in which drawings.

DETAILED DESCRIPTION OF THE INVENTION

Figure 1:
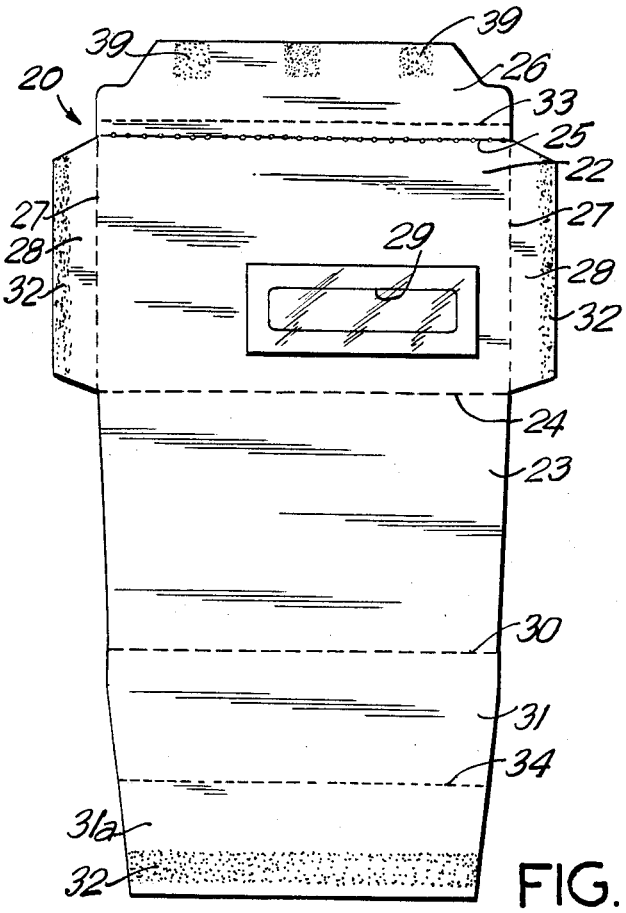
FIG. 1 is a plan view of a blank from which a two-way envelope made in accordance with the present invention may be assembled, showing the inner surface thereof.

Referring to the drawings and particularly to FIGS. 1–8, there is shown the construction of a two-way envelope 21 formed from a one-piece blank 20, best shown in FIG. 1. The blank 20 is cut out to provide a front panel 22 and a back panel 23 joined along a first fold line 24. The front panel 22 includes a perforated second fold line 25. The back panel 23 is joined along a third fold line 30 to a second used flap 31, hereinafter referred to as the return sealing flap. The front panel 22 is joined along a fourth fold line 33 to a first sealing flap 26. If desired, blank 20 may be formed with one or more windows such as window 29 formed in the front panel 22 for displaying the address of the initial addressee. Side flaps 28 are joined along fold lines 27 to each end of the front panel 22. Adhesive is applied in the well-known manner, adjacent all of the marginal adges of the flaps as indicated at 32, but only that applied to the side of flaps 28 is used in making up or assembling the envelope 21 from the blank 20.

A fourth fold line 33 extending across the front panel 22, spaced from and parallel to the perforated line 25, is provided for a purpose hereinafter more fully set forth.

It is to be noted that each of the fold lines is a machine made score line which makes the material of the blank, usually paper, readily foldable either by hand or by succeeding stages of high speed envelope making machinery.

Figure 4:
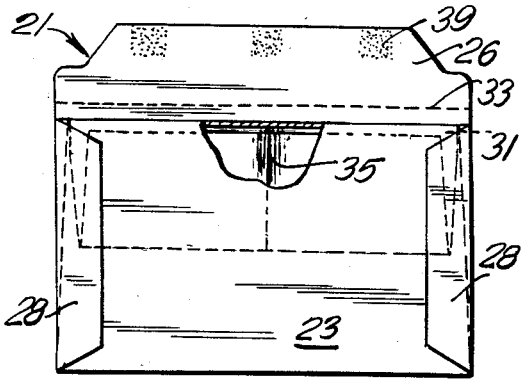
FIG. 4 is a view in rear elevation of an assembled two-way envelope according to the present invention.

The return sealing flap 31, according to the present invention, must be of a length great enough to cover not only the window 29, but also substantially the entire front face of the front panel 22 down to the bottom of the envelope 21 after it is made up. Since the return sealing flap is carried within the pocket of the envelope 21 during the initial mailing of the envelope as best shown in FIG. 4, the said return sealing flap is doubled over upon itself in the manner shown in FIG. 2 along a fifth fold line 34. However, even doubled over upon itself, the return sealing flap 31 will extend into the envelope a distance which makes it difficult to withdraw it from the pocket of the envelope by reaching in and grasping the free edge of the folded flap with the finger tips.

Figure 3:
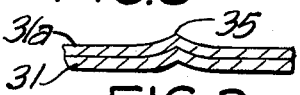
FIG. 3 is a fragmentary cross-sectional view taken on line 3—3 in FIG. 2.
Figure 2:
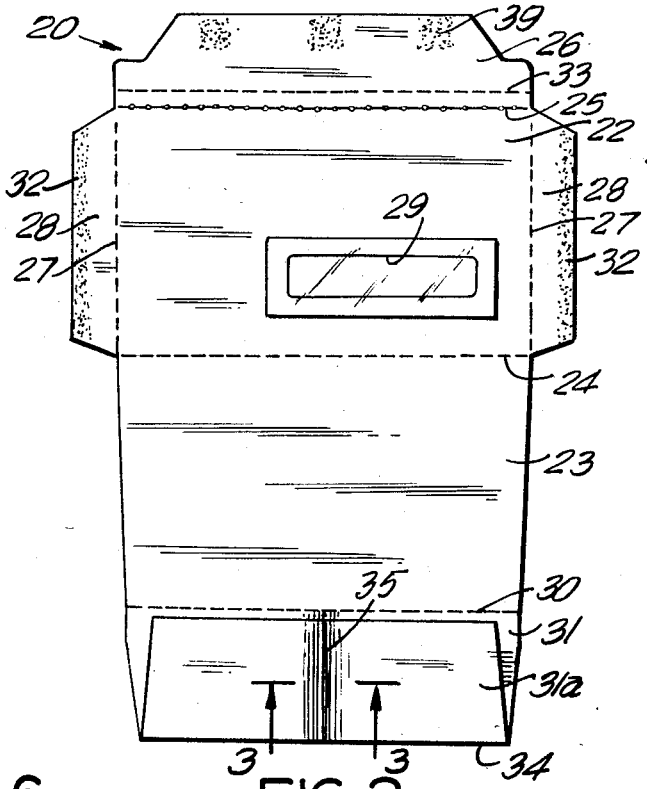
FIG. 2 is a development view of the blank shown in FIG. 1, showing the first steps in assembling the two-way envelope.

Accordingly, after the lower half of the return sealing flap 31, indicated at 31*a*, is folded over along the fifth fold line 34 as shown in FIG. 2, the return sealing flap 31 is crimped as best shown at 35 in FIGS. 2 and 3. The envelope is then made up by folding the return sealing flap 31 again on fold line 30 so as to bring the lower portion 31*a* of the said return sealing flap to bear against the inner surface of the back panel 23. The side flaps 28 are then folded inwardly along fold lines 27 and adhered to the outer surface of the back panel 23 as shown in FIG. 4. The envelope is thus made up and ready to receive a mailing piece or insertion 36, best shown in FIG. 6. The first sealing flap 26 can then be folded over along the fourth fold line 33 and sealed to the outside of the back panel 23 in the usual manner. The envelope, in cross-section, will now appear as shown on the enlarged drawing of FIG. 6.

Figure 5:
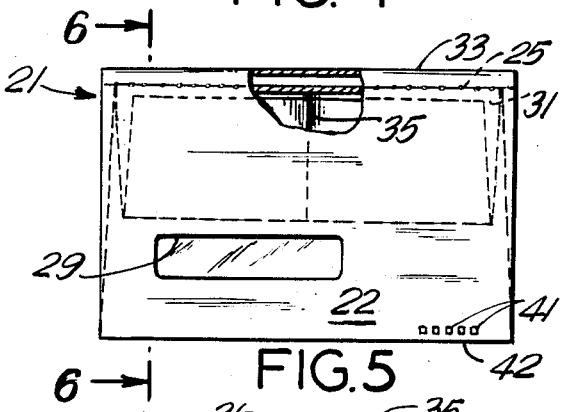
FIG. 5 is a view in front elevation showing the envelope of FIG. 4 sealed for the first trip.

The front of the envelope will have the appearance shown in FIG. 5 and as the envelope is carried through the automated and computerized postal routing equipment, certain indicia shown at 41 will be printed on the front of the envelope adjacent the bottom 42 thereof. This printing will be done with magnetic ink for appropriate sensing of the information thus carried by the envelope.

Figure 6:
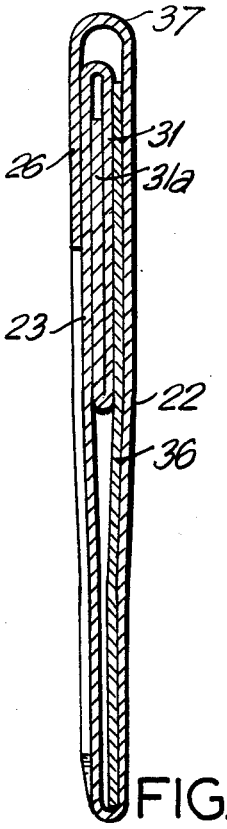
FIG. 6 is a view in cross-section taken on line 6—6 in FIG. 5, on an enlarged scale.

Upon receipt of the letter, the recipient either inserts a letter opener into the loop 37 formed at the top of the envelope by reason of folding the front panel along score line 33. Since the loop 37 is located above the folded over return sealing flap 31, as shown in FIG. 6, the danger of severing the return sealing flap is substantially eliminated. Alternately, the recipient may open the envelope by lifting the first sealing flap 26 and breaking the seal of the adhesive spots 39 carried on the under surface of the first sealing flap 26. In either event, it is preferred that the first sealing flap 26 and the portion of the front panel 22 between the two fold lines 25, 33 be torn from the front panel along the perforated line 25 before remailing. The recipient may tear off the first sealing flap in the manner described above before or after removing the insert 36 as desired.

Figure 7:
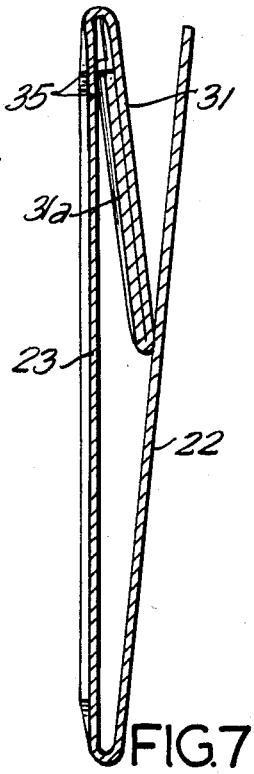
FIG. 7 is a view similar to FIG. 6, showing the envelope after it has been opened by the first recipient and the contents removed from the pocket, on an enlarged scale.

When the insert 36 is removed, it will provide room within the pocket of the envelope and permit the return sealing flap 31 to expand into the pocket as shown in FIG. 7. This expansion is aided by the crimped portion 35 of the return sealing flap 31 which acts in the manner of a spring to not only lift the return sealing flap 31 away from the inner surface of the back panel, but also to draw the sides of the return sealing flap away from the side seams of the envelope formed where the side flaps 28 hold the front and back panels 22, 23 together. The result of the operation of the crimped portion 35 is not only to make it easier for the recipient to locate the bottom of the return sealing flap 31 within the envelope, but also to cause the envelope return sealing flap to flex along the crimp 35, making it easier to withdraw the return sealing flap without damaging either the flap or the remainder of the envelope as it is being prepared for the return trip.

Figure 9:
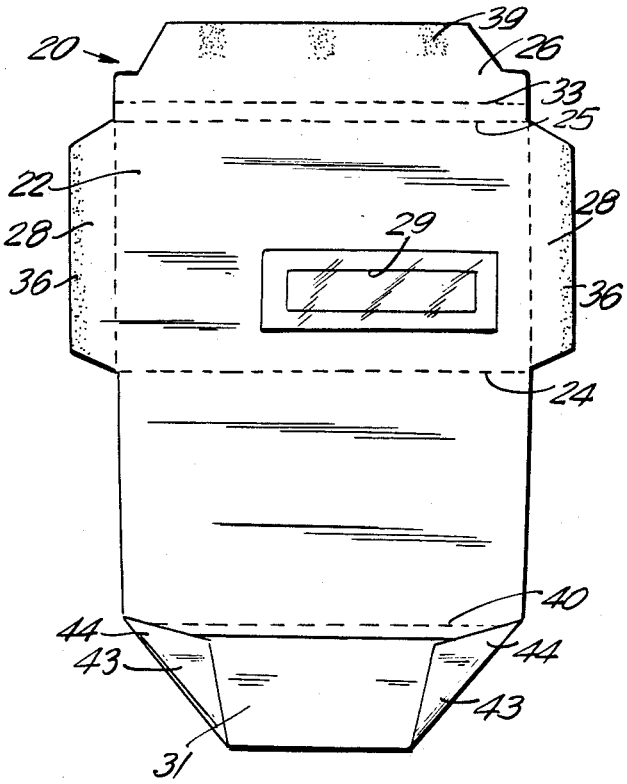
FIG. 9 is a plan view, partially developed of a blank similar to FIG. 1, a second embodiment of the invention.
Figure 10:
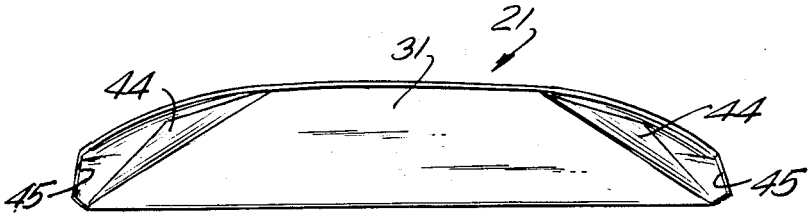
FIG. 10 is a top view, somewhat enlarged, of the made-up envelope of FIG. 9 after the insert has been removed and the first sealing flap severed from the envelope.

In the embodiment shown in FIGS. 9 and 10, the envelope is made up from a blank similar to the blank 20 shown in FIG. 1. In this embodiment, however, the return sealing flap 31 is first folded upon itself in the manner shown in FIG. 2 and thereafter the sides of the flap indicated at 43 are folded inwardly in the manner shown in FIG. 9. The two flaps 44 thus formed are next swung back to their original position so that they lie in the plane of the return sealing flap 31. The envelope is then made up as follows: the return sealing flap is folded upon fold line 40 so that it is disposed upon the inner surface of the back panel 23, the back panel is folded upon the first line 24 and the side flaps 28 moistened in the area of their adhesive strips 36 and folded upon the outer surface of the back panel 23 to complete the envelope.

After the envelope has been received by the first recipient, the first sealing flap 26 is opened and torn off along the perforated line 25. When the contents of the envelope or the insert is removed the top view of the pocket will appear as shown in FIG. 10. It will be noted that the flaps 44 have pushed the return sealing flap away from the back panel, thereby moving the return sealing flap away from the surface of the back panel so that the recipient can locate the bottom of the said return sealing flap. As the flap is withdrawn, the flaps 44 bend inwardly and away from the side seams 45 so that the return sealing flap is easily pulled out of the pocket of the envelope without getting caught in the side seams or damaging said seams.

Figure 8:
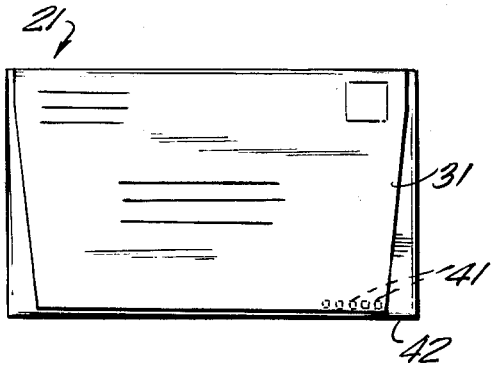
FIG. 8 is a view in front elevation of an envelope sealed, ready for its second or return trip.

On the return trip of the envelopes disclosed herein, the back panel 23, which is of the same size as the front panel 22 from the first fold line 24 to the second fold line 25, easily folds over the front of the envelope and when the return sealing flap is unfolded the said sealing flap 31 substantially covers the entire front face of the envelope in the manner shown in FIG. 8. It will be observed that the indicia 41, indicated in dotted lines in FIG. 8, is completely covered by the return sealing flap so that new indicia may be placed upon the front of the envelope by the postal carrier on its return trip.

Having fully described the invention, what is desired to be claimed and secured by Letters Patent is:

1. An envelope for multiple mailing comprising a first panel having side, top and bottom borders and having inner and outer surfaces, a second panel having side, top and bottom borders and having inner and outer surfaces, said first and second panels joined together in overlying relationship along their side and bottom borders, a first sealing flap joined to said top border of said first panel and foldable overlying a portion of the outer surface of said second panel for joining the top borders of said first and second panels during a first mailing of said envelope, a second sealing flap joined to said top border of said second panel and foldable into a first position between the inner surfaces of said first and second panels and a second position overlying a portion of the outer surfaces of said first panel for joining the top borders of said first and second panels during a second mailing of said envelope, and displacing means comprising a deformed portion of said second sealing flap arranged at an angle to the top border of said second panel for displacing a lower portion of said second sealing flap away from the inner surface of said second panel to facilitate engagement of said lower portion of said second sealing flap when folding said second sealing flap from said first position into said second position.

2. The envelope of claim 1 wherein said second sealing flap is of sufficient length to overly substantially the entire said outer surface of said first panel when in said second position.

3. The envelope of claim 2 wherein said second sealing flap includes a fold line spaced from said top border of said second panel to divide said second sealing flap into an upper half and a lower half.

4. The envelope of claim 3 wherein said lower half of said second sealing flap is folded about said fold line and arranged between said upper half of said second sealing flap and the inner surface of said second panel.

5. The envelope of claim 4 wherein said fold line is positioned substantially midway along the length of said second sealing flap.

6. The envelope of claim 1 wherein said deformed portion of said second sealing flap comprises a crimped portion of said second sealing flap.

7. The envelope of claim 1 wherein said second sealing flap has side borders and said deformed portion is arranged substantially midway between said borders of said second sealing flap.

8. The envelope of claim 1, wherein said deformed portion comprises a fold line arranged substantially normal to the top border of said second panel.

9. The envelope of claim 1 wherein said displacing means comprises a pair of spaced-apart deformed portions of said second sealing flap.

10. The envelope of claim 9 wherein said pair of deformed portions are arranged at an angle to the top border of said second panel.

11. The envelope of claim 10 wherein said deformed portions comprise angular folds formed by bending over the corners of said second sealing flap and thereafter straightening said deformed portions before arranging said second sealing flap in said first position.

12. The envelope of claim 1 further including a fold line arranged on one of said sealing flaps and spaced from said top border of an adjacent joined panel, said one of said sealing flaps being folded along said fold line during mailing of said envelope.

13. The envelope of claim 12 wherein said fold line is arranged on said first sealing flap and parallel to said top border of said first panel.

14. The envelope of claim 13 wherein the combined height of said first panel and that portion of said first sealing flap between said fold line and said top border of said first panel is greater than the height of said second panel.

15. The envelope of claim 13 wherein said first sealing flap is joined to said first panel along a line of perforations.

16. The envelope of claim 15 wherein said fold line comprises a score line.

17. An envelope for multiple mailing comprising a first panel having side, top and bottom borders and having inner and outer surfaces, a second panel having side, top and bottom borders and having inner and outer surfaces, said first and second panels joined together in overlying relationship along their side and bottom borders, a first sealing flap joined to said top border of said first panel and foldable overlying a portion of the outer surface of said second panel for joining the top borders of said first and second panels during a first mailing of said envelope, a second sealing flap having side borders and joined to said top border of said second panel, said second sealing flap foldable into a first position between the inner surfaces of said first and second panels and a second position overlying a portion of the outer surface of said first panel for joining the top borders of said first and second panels during a second mailing of said envelope, and displacing means provided on a portion of said second sealing flap for drawing said side borders of said second sealing flap away from said side borders of said first and second panels to displace a lower portion of said second sealing flap away from the inner surface of said second panel to facilitate engagement of said lower portion of said second sealing flap when folding said second sealing flap from said first position into said second position.

18. The envelope of claim 17 wherein said second sealing flap is of sufficient length to overly substantially the entire said outer surface of said first panel when in said second position.

19. The envelope of claim 18 wherein said second sealing flap includes a fold line spaced from said top border of said second panel to divide said second sealing flap into an upper half and a lower half.

20. The envelope of claim 19 wherein said lower half of said second sealing flap is folded about said fold line and arranged between said upper half of said second sealing flap and the inner surface of said second panel.

21. The envelope of claim 20 wherein said fold line is positioned substantially midway along the length of said second sealing flap.

22. The envelope of claim 17 wherein said displacing means comprises a deformed portion of said second sealing flap.

23. The envelope of claim 22 wherein said deformed portion of said second sealing flap comprises a crimped portion of said second sealing flap.

24. The envelope of claim 22 wherein said deformed portion is arranged substantially midway between said side borders of said second sealing flap.

25. The envelope of claim 22 wherein said deformed portion comprises a fold line arranged substantially normal to the top border of said second panel.

26. The envelope of claim 17 wherein said displacing means comprises a pair of spaced-apart deformed portions of said second sealing flap.

27. The envelope of claim 26 wherein said pair of deformed portions are arranged at an angle to the top border of said second panel.

28. The envelope of claim 27 wherein said deformed portions comprise angular folds formed by bending over the corners of said second sealing flap and thereafter straightening said deformed portions before arranging said second sealing flap in said first position.

29. The envelope of claim 17 further including a fold line arranged on one of said sealing flaps and spaced from said top border of an adjacent joined panel, said one of said sealing flaps being folded along said fold line during mailing of said envelope.

30. The envelope of claim 29 wherein said fold line is arranged on said first sealing flap and parallel to said top border of said first panel.

31. The envelope of claim 30 wherein the combined height of said first panel and that portion of said first sealing flap between said fold line and said top border of said first panel is greater than the height of said second panel.

32. The envelope of claim 30 wherein said first sealing flap is joined to said first panel along a line of perforations.

33. The envelope of claim 32 wherein said fold line comprises a score line.

* * * * *